US008973200B2

(12) United States Patent
Mallett

(10) Patent No.: US 8,973,200 B2
(45) Date of Patent: Mar. 10, 2015

(54) ERGONOMIC SWEEPING DEVICE

(71) Applicant: Mark Mallett, Antioch, CA (US)

(72) Inventor: Mark Mallett, Antioch, CA (US)

( * ) Notice: Subject to any disclaimer, the term of this patent is extended or adjusted under 35 U.S.C. 154(b) by 0 days.

(21) Appl. No.: 13/826,508

(22) Filed: Mar. 14, 2013

(65) Prior Publication Data

US 2013/0269131 A1 Oct. 17, 2013

Related U.S. Application Data

(60) Provisional application No. 61/622,540, filed on Apr. 11, 2012.

(51) Int. Cl.

| | |
|---|---|
| ***A46B 5/02*** | (2006.01) |
| ***B25G 1/04*** | (2006.01) |
| ***B25G 1/10*** | (2006.01) |
| ***A46B 5/00*** | (2006.01) |

(52) U.S. Cl.

CPC ..... *A46B 5/00* (2013.01); *A46B 5/0095* (2013.01); *A46B 5/0058* (2013.01); *A46B 5/02* (2013.01); *B25G 1/04* (2013.01); *A46B 5/0033* (2013.01); *A46B 2200/302* (2013.01)

USPC ..... 15/144.1; 15/143.1; 15/144.4; 16/426; 16/429; 16/430; D4/138; D32/50; D32/51

(58) Field of Classification Search

USPC ..... 15/143.1, 144.1–144.4, 145; 16/426, 16/427, 429, 430; D4/138; D32/50, 51, 52

See application file for complete search history.

(56) References Cited

U.S. PATENT DOCUMENTS

| | | | | |
|---|---|---|---|---|
| 3,981,043 | A | 9/1976 | Curry | |
| 4,888,846 | A * | 12/1989 | Natale | 15/236.01 |
| 5,065,475 | A | 11/1991 | Watt | |
| 5,455,981 | A * | 10/1995 | Wiese | 15/236.01 |
| 5,529,357 | A * | 6/1996 | Hoffman | 294/58 |
| 5,771,535 | A * | 6/1998 | Blessing | 16/430 |
| 6,170,112 | B1 | 1/2001 | Mayfield | |
| 6,199,245 | B1 * | 3/2001 | Blessing | 16/430 |
| 6,464,272 | B1 * | 10/2002 | Michaud | 294/58 |
| 6,742,222 | B2 | 6/2004 | Furr-Britt | |
| 7,300,081 | B1 | 11/2007 | Murray | |
| 7,971,914 | B1 | 7/2011 | Pladson | |
| 2004/0055099 | A1 | 3/2004 | Greenberg | |
| 2010/0005607 | A1 | 1/2010 | DelaBarre | |
| 2010/0139047 | A1 | 6/2010 | Eek | |
| 2010/0299855 | A1 * | 12/2010 | Megeath | 15/22.1 |
| 2011/0099765 | A1 * | 5/2011 | Youssefieh | 16/430 |

FOREIGN PATENT DOCUMENTS

| | | |
|---|---|---|
| DE | 3517538 | * 11/1986 |
| GB | 2248034 | * 3/1992 |
| JP | 2003-116635 | * 4/2003 |
| WO | 02/090059 | * 11/2002 |

* cited by examiner

*Primary Examiner* — Mark Spisich

(74) *Attorney, Agent, or Firm* — Stuart J. West; West & Associates, A PC

(57) ABSTRACT

An ergonomic sweeping device that can be used with one hand while providing a user with proper biomechanical alignment and support, which can reduce muscular strain, fatigue, and the potential for injury.

17 Claims, 5 Drawing Sheets

ERGONOMIC SWEEPING DEVICE

CROSS REFERENCE TO RELATED APPLICATIONS

This Application claims priority under 35 U.S.C. §119(e) from earlier filed U.S. Provisional Application Ser. No. 61/622,540, filed Apr. 11, 2012, the entirety of which is incorporated herein by reference.

BACKGROUND

Technical Field

The present device is related to the field of custodial tools, particularly ergonomic sweeping devices.

When sweeping a floor, one usually has to sweep the debris into a pile and then bring a dustpan or other receptacle to remove it. Although this method is sufficient for small areas, it is inconvenient and inefficient for larger areas, such as warehouses, parking lots, and amusement parks. One way to increase sweeping efficiency in these situations is to hold a broom in one hand, while holding a dustpan in the other.

However, sweeping one-handed for an extended period of time can cause fatigue and strain in the upper extremities, particularly the hand and forearm. Further, excessive bending or spinal torsion can strain the shoulders and back. This can lead to reduced work performance, as well as potential injury.

What is needed is an ergonomically designed sweeping device that encourages proper biomechanics while sweeping in an efficient one-handed fashion.

SUMMARY

The present device provides ergonomic, one-handed operation of a sweeping device, allowing a user to more efficiently sweep a floor or other area with less muscle fatigue and strain.

BRIEF DESCRIPTION OF THE DRAWINGS

Further details of the present invention are explained with the help of the attached drawings in which.

DETAILED DESCRIPTION

Figure 1:
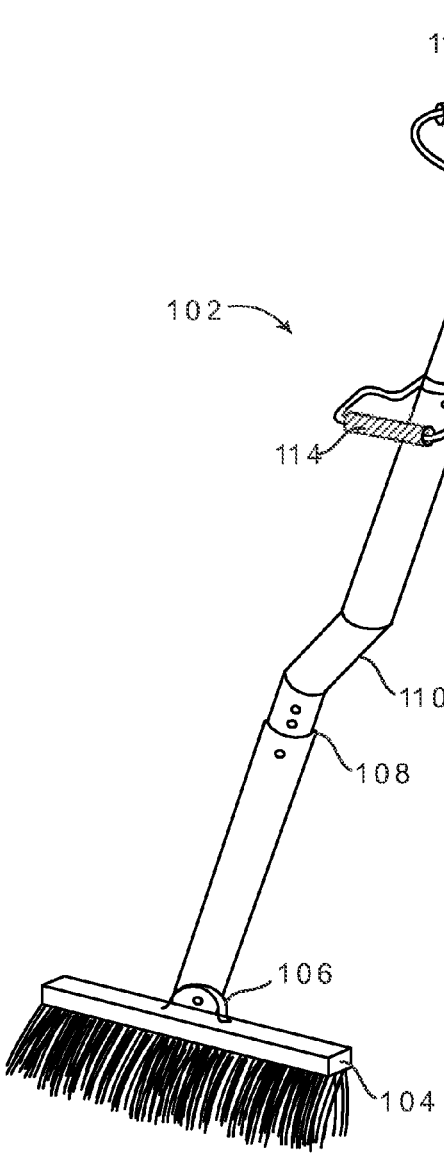
FIG. 1 depicts a perspective view of one embodiment of the present device.
Figure 1A:
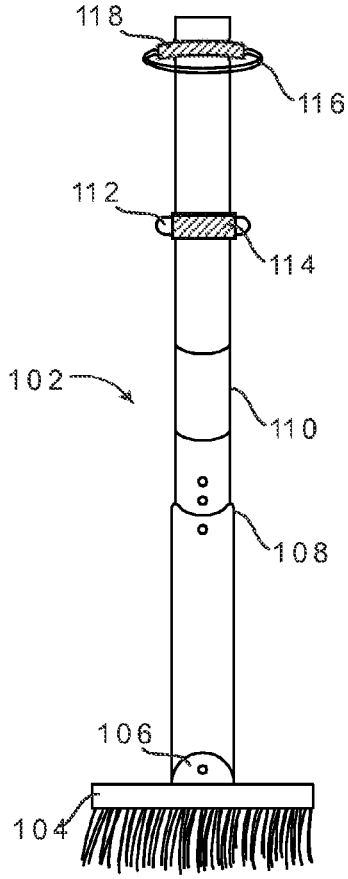
FIG. 1*a* depicts a front planar view of the embodiment shown in FIG. 1.
Figure 1B:
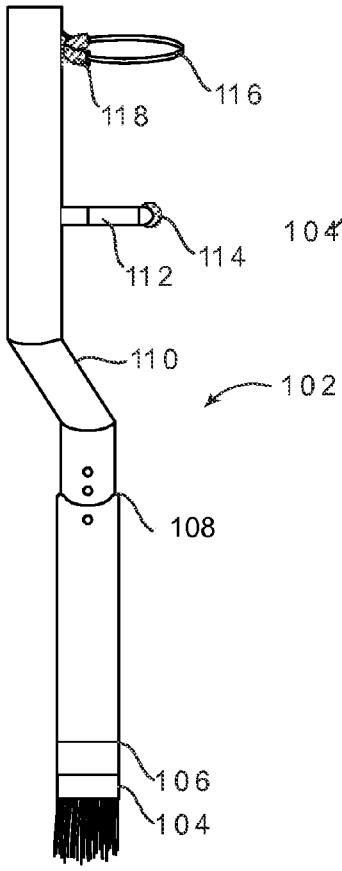
FIG. 1*b* depicts a side view of the embodiment shown in FIG. 1.

As shown in FIG. 1, an elongated member 102 can have a proximal end and a distal end. As shown in FIG. 1, an elongated member 102 can be tubular with a substantially circular cross-sectional geometry, but in other embodiments can be partially or substantially completely solid along its length and can have any other known and/or convenient cross-sectional geometry. An elongated member 102 can be made from polymer, metal, or any other known and/or convenient material. In some embodiments, the material comprising an elongated member 102 can be selected to minimize the weight of the device.

In some embodiments, the distal end of an elongated member 102 can be connected to a bristle assembly 104 via a pivoting connector 106. In such embodiments, a bristle assembly 104 can rotate laterally up to 90-degrees in each direction with respect to the distal end of an elongated member 102. In such embodiments, the rotational motion of a pivoting connector 106 can be controlled via friction fit, a locking pin or nut, or any other known and/or convenient device. However, in other embodiments, a bristle assembly 104 can be removably connected substantially perpendicularly to the distal end of an elongated member 102. In some embodiments, a bristle assembly 104 can be interchangeable. A bristle assembly 104 can be comprised of bristles made of polymer, natural fibers, or any other known and/or convenient material, affixed to a base made of polymer, metal, wood, or any other known and/or convenient material.

In the embodiment shown in FIG. 1, an elongated member 102 can have an adjustable length via a distal adjustment mechanism 108. In such embodiments, a distal adjustment mechanism 108 can also allow for up to 180-degree rotation of the longitudinal axis of a bristle assembly 104 and adjacent elongated member 102. In some embodiments, a distal adjustment mechanism 108 can be a spring-loaded locking-button device, but in other embodiments can be a locking pin or nut, threaded connection, friction fit or any other known and/or convenient device. In other embodiments, an elongated member 102 can have a fixed length.

As shown in FIG. 1, an elongated member 102 can have an offset region 110 located substantially at the midpoint of an elongated member 102. In such embodiments, an elongated member 102 can be divided into a distal portion and a proximal portion substantially at the point of an offset region 110. In the embodiment shown in FIG. 1, an offset region 110 can be located superior to an adjustment mechanism 108, but in other embodiments can be located inferior to an adjustment mechanism 108.

In some embodiments, an offset region 110 can be comprised of two opposite angular bends of approximately 45-degrees relative to the central axis of an elongated member 102, such that the central axis of the proximal portion of an elongated member 102 can be shifted posterior to the central axis of the distal portion of an elongated member 102. However, in other embodiments, the bends can be any other known and/or convenient angular measurement.

As shown in FIG. 1, a handle 112 can be connected superior to an offset region 110 at a point between approximately the midpoint of the proximal portion of an elongated member 102 and an offset region 110. In some embodiments, a handle 112 can be connected to an elongated member 102 such that the grip portion of a handle 112 can be substantially parallel to the longitudinal axis of a bristle assembly 104. In some embodiments, a handle 112 can be removably connected to an elongated member 102 via rivets, pins, adhesive, or any other known and/or convenient device. In other embodiments, a handle 112 can be integrated with or affixed to an elongated member 102 via a welded joint, molding, or any other known and/or convenient process.

In some embodiments, a handle 112 can further comprise a padded grip member 114. In such embodiments, a padded grip member 114 can have texturing to increase friction with a user's hand to improve grip. A padded grip member 114 can be comprised of foam, neoprene, textile, or any other known and/or convenient material.

As shown in the embodiment in FIG. 1, a forearm support member 116 can be located superior to a handle 112 at a point substantially proximal to the proximal end of an elongated member 102. A forearm support member 116 can be in substantially linear alignment with a handle 112 along an axis substantially parallel to the central longitudinal axis of the proximal portion of an elongated member 102. However, in other embodiments, a forearm support member 116 can be located in any other known and/or convenient location on the proximal portion of an elongated member 102.

In some embodiments, a forearm support member 116 can be removably connected to an elongated member 102 via rivets, pins, adhesive, or any other known and/or convenient device. In other embodiments, a forearm support member 116 can be integrated with or affixed to an elongated member 102 via a welded joint, molding, or any other known and/or convenient process.

In the embodiment shown in FIG. 1, a forearm support member 116 can have a substantially closed-loop configuration. As shown in FIG. 1, a forearm support member 116 can have a substantially circular geometry, but in other embodiments can have an ovoid, quadrilateral, polygonal, or any other known and/or convenient geometrical configuration.

In some embodiments, a forearm support member 116 can further comprise a padded member 118. As shown in FIG. 1, a padded member 118 can cover a portion of the circumference of a forearm support member 116 substantially adjacent to an elongated member 102. However, in other embodiments, a padded member 118 can cover substantially the entire surface of a forearm support member, the circumferential interior region, or any other known and/or convenient portion of the surface of a forearm support member 116. In some embodiments, a padded member 118 can have texturing to increase friction with a user's arm. A padded member 118 can be comprised of foam, neoprene, textile, or any other known and/or convenient material.

Figure 2A:
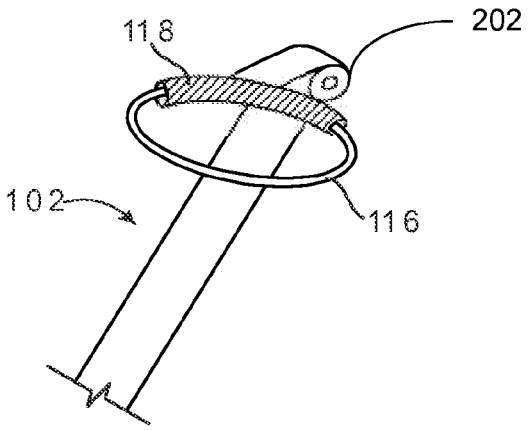
FIG. 2*a* depicts a perspective view of an alternative embodiment of a forearm support member in the present device.

As shown in FIG. 2*a*, a forearm support member 116 can be removably connected to the proximal end of an elongated member 102 via a pivoting connector 202 having an axis of rotation substantially parallel to the longitudinal axis of a bristle assembly 104. A pivoting connector 202 can have a range of motion of approximately 0-90 degrees. In such embodiments, a forearm support member 116 can be rotated from the deployed position (substantially perpendicular to the longitudinal axis of the proximal portion of an elongated member 102) to be substantially aligned with the longitudinal axis of the proximal portion of an elongated member 102 in order to also be used as a hanging device.

Figure 2B:
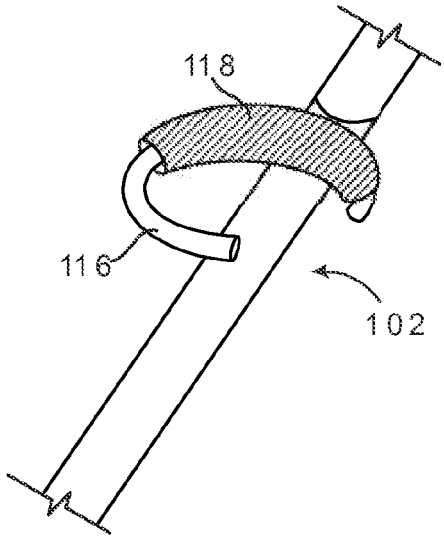
FIG. 2*b* depicts a perspective view of an alternative embodiment of a forearm support member in the present device.

As shown in FIG. 2*b*, a forearm support member 116 can have an open-loop configuration, having an opening of sufficient dimensions to allow a forearm to laterally enter the interior portion of a forearm support member 116.

Figure 2C:
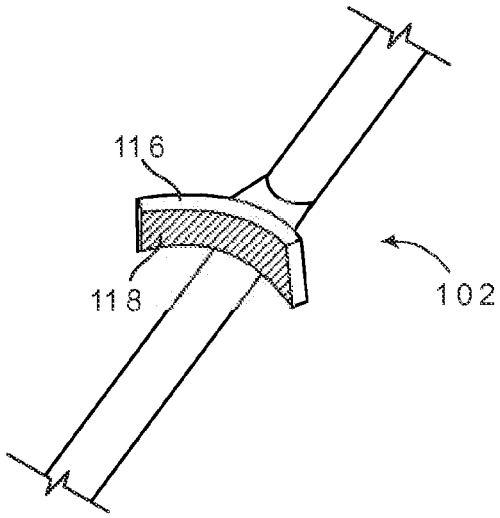
FIG. 2*c* depicts a perspective view of an alternative embodiment of a forearm support member in the present device.

As shown in FIG. 2*c*, a forearm support member 116 can have an arc configuration of sufficient curvature and dimensions to comfortably rest against a forearm, or any other known and/or convenient geometry. In such embodiments, a padded member 118 can substantially cover the interior surface of a forearm support member 116. However, in other embodiments a padded member 118 can cover any known and/or convenient portion of the interior surface of a forearm support member 116.

Figure 3A:
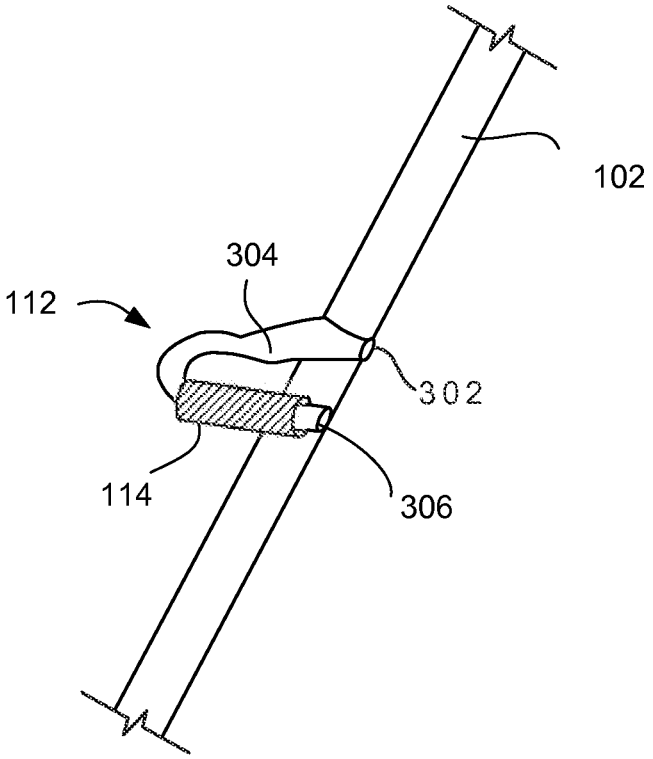
FIG. 3*a* depicts a perspective view of an alternative embodiment of the alternate handle in the present device.

As shown in FIG. 3*a*, a handle 112 can be removably connected to the proximal end of an elongated member 102 via a pivoting connector 302 having an axis of rotation substantially parallel to the longitudinal axis of a bristle assembly 104. A pivoting connector 302 can have a range of motion of approximately 0-90 degrees. In such embodiments, a handle 112 can be rotated from the deployed position (substantially perpendicular to the longitudinal axis of the proximal portion of an elongated member 102) to rest against an elongated member 102 to make the present device more compact for storage.

Figure 3B:
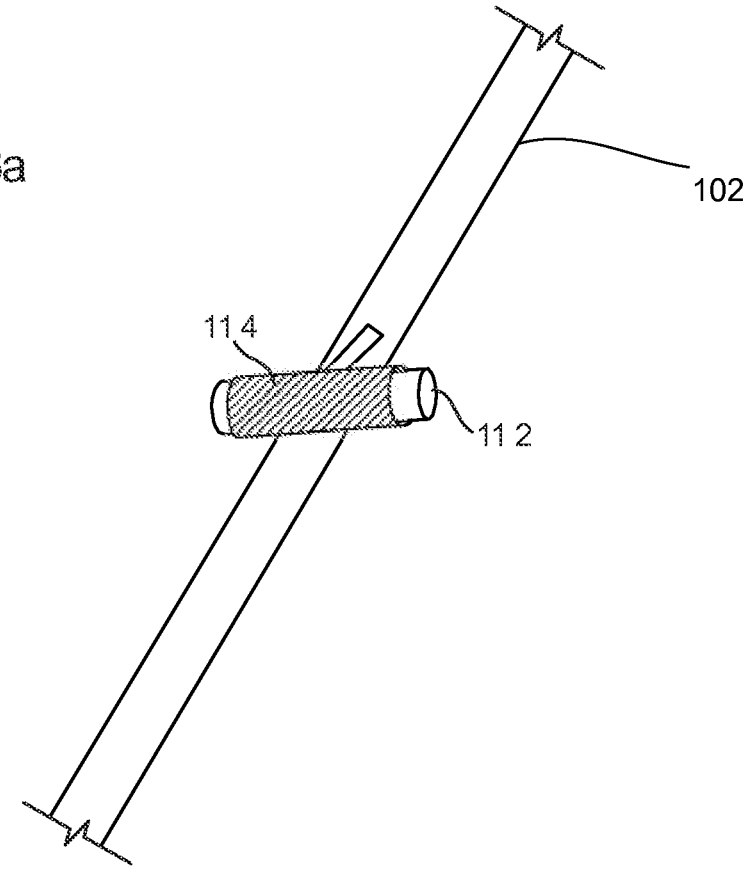
FIG. 3*b* depicts a perspective view of an alternative embodiment of the alternate handle in the present device.

In some embodiments, as shown in FIG. 3*a*, a handle 112 can have a partial-loop configuration in which a first handle section 304 extends substantially perpendicularly from the longitudinal axis of an elongated member 102 and curves into a second handle section 306 than can terminate such that the grip portion of a handle 112 can be substantially parallel to a bristle assembly 104. However, in other embodiments, as shown in FIG. 3*b*, a handle 112 can also have a "t-shaped" configuration or any other known and/or convenient configuration.

As shown in FIG. 1, a padded grip 114 can substantially cover the exterior surface of a handle 112. However, in other embodiments a padded grip 114 can cover any known and/or convenient portion of the exterior surface of a handle 112.

Figure 4:
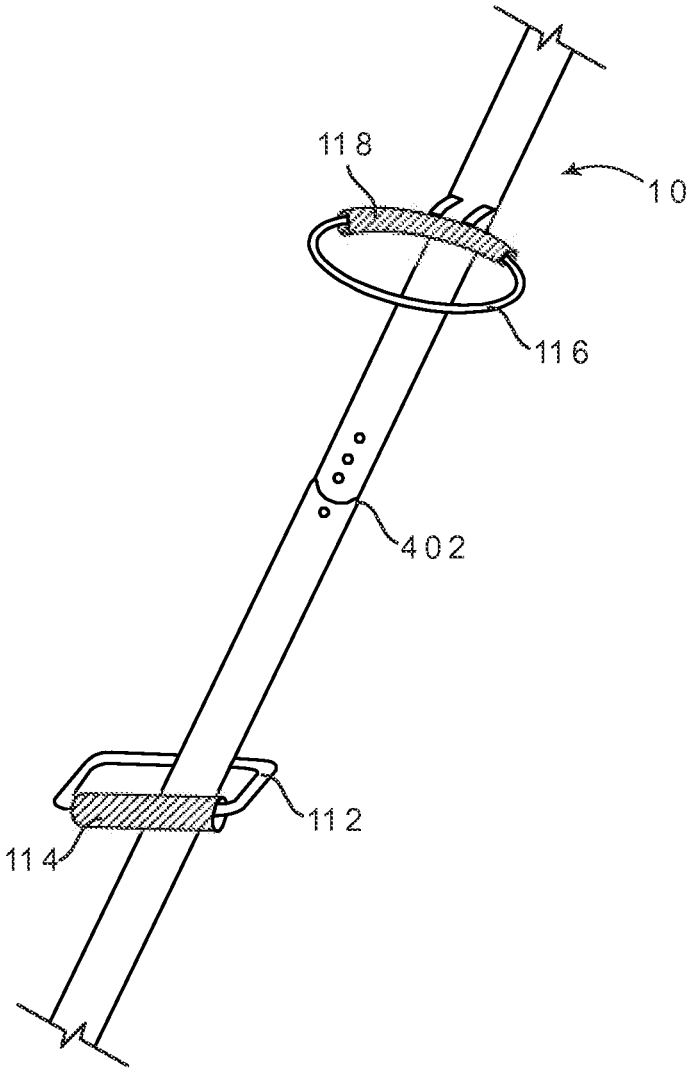
FIG. 4 depicts a perspective view of another embodiment of the present device having an adjustment mechanism positioned between a handle and a forearm support.

In some embodiments, as shown in FIG. 4, the proximal portion of an elongated member 102 can further comprise a proximal adjustment mechanism 402 positioned between a handle 112 and a forearm support member 116. In some embodiments, a proximal adjustment mechanism 402 can be a spring-loaded locking-button device, but in other embodiments can be a locking pin or nut, threaded connection, friction fit or any other known and/or convenient device. In such embodiments, adjusting the length of the proximal portion of an elongated member 102 can provide the optimal distance between a handle 112 and a forearm support 116 for proper biomechanical support and user comfort.

Figure 5:
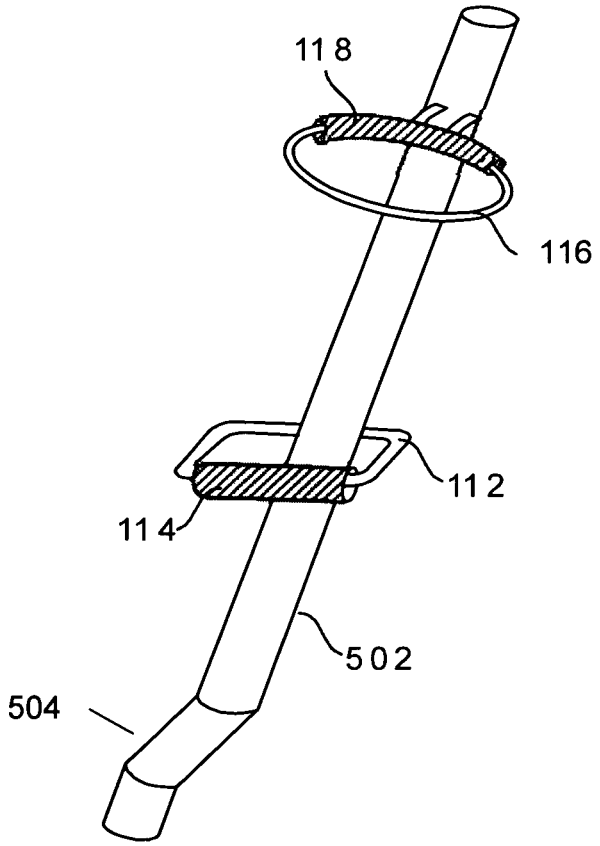
FIG. 5 depicts a perspective view of another retrofitting kit embodiment of the present device.

As shown in FIG. 5, the present device can have a retrofitting kit embodiment that can convert a standard sweeping device into an ergonomic sweeping device. In such embodiments, an elongated member 502 can have an offset region 504 located substantially proximal to the distal end of an elongated member 502. In such embodiments, an elongated member 502 can be divided into a shorter distal portion and a longer proximal portion substantially at the point of an offset region 504.

In some embodiments, an offset region 504 can be comprised of two opposite angular bends of approximately 45-degrees relative to the central axis of an elongated member 502, such that the central axis of a proximal portion of an elongated member 502 can be shifted posterior to the central axis of a distal portion of an elongated member 502. However, in other embodiments, the bends can be any other known and/or convenient angular measurement.

In some embodiments, at least the distal portion can be substantially hollow, having an interior cross-sectional geometry to selectively engage with a standard broomstick. In some embodiments, an elongated member 502 can be substantially hollow or tubular with a substantially cross-sectional geometry, but in other embodiments can be solid or partially solid from an offset region 504 up through the proximal portion of an elongated member 502 and can have any other known and/or convenient cross-sectional geometry. An elongated member 502 can be made from polymer, metal, or any other known and/or convenient material. In some embodiments, the material comprising an elongated member 102 can be selected to minimize the weight of the device.

In use, a person can pass an arm through a forearm support member 116 and grip a handle 112 such that the back of the hand can be adjacent to an elongated member 102 and the dorsal side of the forearm can rest against a forearm support member 116. While pulling the device forward in a sweeping motion over a floor, frictional forces between the floor and a bristle assembly 104 can create a moment about a handle 112, creating a force on the dorsal side of a forearm at the point of contact with a forearm support member 116. This can provide ergonomic support at the forearm, which can enable a person to operate the present device one-handed. Such one-handed operation frees a user's other hand to carry a receptacle or dustpan for removing any swept-up debris.

In embodiments, such as those shown in FIG. 1 and FIGS. 2*a* and 2*b*, a forearm support member 116 can contact a forearm both on the dorsal and frontal sides, thus providing support during forward and backward sweeping motions. In embodiments such as that shown in FIG. 2*c*, forearm support can be limited to only the dorsal side of the forearm, making the present device primarily effective for forward sweeping motion.

As a forearm passes either through or adjacent to a forearm support 116 and a hand grips a handle 112, the central longitudinal axis of a forearm can be aligned substantially parallel to the central longitudinal axis of the proximal portion of an elongated member 102. An offset region 110 can allow the central longitudinal axis of a user's forearm to be substantially aligned with the central longitudinal axis of the distal portion of an elongated member 102. This can improve the balance of the present device and reduce user fatigue.

In embodiments having a distal adjustment mechanism 108, the length of an elongated member 102 can be adjusted to the height of a user. This can reduce back fatigue and strain by decreasing the user's need to stoop or bend over during a sweeping motion.

In embodiments having a proximal adjustment mechanism 402, the length of the proximal section of an elongated member 102, and, therefore, the distance between a handle 112 and a forearm support 116 can be adjusted to fit a user's forearm, which can improve comfort and reduce upper extremity fatigue and strain.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed:

1. An ergonomic sweeping device, comprising:

an elongated member having a distal end and a proximal end and wherein an angled offset region delineates a proximal portion and a distal portion;

a bristle assembly removably connected to the distal end of said elongated member;

a handle with a grip portion, removably attached to the proximal portion of the elongated member and oriented such that said grip portion is substantially parallel to the longitudinal axis of the bristle assembly and such that the transverse midpoint of the grip portion is substantially aligned with the central longitudinal axis of the distal portion of the elongated member; and a forearm support, removably attached to the proximal portion of the elongated member and located superior to said handle and oriented in substantially linear alignment with said handle along an axis substantially parallel to the central longitudinal axis of said proximal portion of the elongated member;

wherein said bristle assembly is removably connected via a pivoting connector having a range of rotational motion up to 90-degrees in each direction with respect to the distal end of said elongated member.

2. The device of claim 1, wherein said handle further comprises a padded grip member.

3. The device of claim 2, wherein said forearm support further comprises a padded member.

4. The device of claim 3, wherein said elongated member is adjustable and further comprises an adjustment mechanism in the distal portion of said elongated member.

5. The device of claim 4, wherein said elongated member is adjustable and further comprises an adjustment mechanism in the proximal portion of said elongated member, located between said handle and said forearm support.

6. The device of claim 5, wherein said adjustment mechanism is a spring-loaded locking button device.

7. The device of claim 4, wherein said adjustment mechanism is a spring-loaded locking button device.

8. The device of claim 1, wherein said forearm support is a substantially closed-loop configuration.

9. The device of claim 1, wherein said forearm support is an open-loop configuration.

10. An ergonomic sweeping device, comprising:

an elongated member having a distal end and a proximal end and wherein an angled offset region delineates a proximal portion and a distal portion;

a bristle assembly removably connected to the distal end of said elongated member;

a handle with a grip portion, removably attached to the proximal portion of the elongated member and oriented such that said grip portion is substantially parallel to the longitudinal axis of the bristle assembly and such that the transverse midpoint of the grip portion is substantially aligned with the central longitudinal axis of the distal portion of the elongated member;

a forearm support, removably attached to the proximal portion of the elongated member and located superior to said handle and oriented in substantially linear alignment with said handle along an axis substantially parallel to the central longitudinal axis of said proximal portion of the elongated member; and wherein said bristle assembly is removably connected via a pivoting connector having a range of rotational motion up to 90-degrees in each direction with respect to the distal end of said elongated member;

wherein said elongated member is adjustable and further comprises an adjustment mechanism in the proximal portion of said elongated member, located between said handle and said forearm support.

11. The device of claim 10 wherein said handle further comprise a padded grip member.

12. The device of claim 11, wherein said forearm support further comprises a padded member.

13. The device of claim 10, wherein said elongated member is adjustable and further comprises an adjustment mechanism in the distal portion of said elongated member.

14. The device of claim 13, wherein said adjustment mechanism is a spring-loaded locking button device.

15. The device of claim 10, wherein said forearm support is a substantially closed-loop configuration.

16. The device of claim 10, wherein said forearm support is an open-loop configuration.

17. The device of claim 10, wherein said adjustment mechanism is a spring-loaded locking button device.

* * * * *